US009303641B2

(12) United States Patent
Hilpert et al.

(10) Patent No.: US 9,303,641 B2
(45) Date of Patent: Apr. 5, 2016

(54) PISTON WITH REPLACEABLE AND/OR ADJUSTABLE SURFACES

(71) Applicants: Lee Hilpert, Brunswick, GA (US); Rolando Nico M. Ramos, West Palm Beach, FL (US); William W. Blodgett, Sea Island, GA (US)

(72) Inventors: Lee Hilpert, Brunswick, GA (US); Rolando Nico M. Ramos, West Palm Beach, FL (US); William W. Blodgett, Sea Island, GA (US)

(73) Assignee: LOBEPRO, INC., Brunswick, GA (US)

( * ) Notice: Subject to any disclaimer, the term of this patent is extended or adjusted under 35 U.S.C. 154(b) by 0 days.

(21) Appl. No.: 14/206,016

(22) Filed: Mar. 12, 2014

(65) Prior Publication Data

US 2014/0271312 A1 Sep. 18, 2014

Related U.S. Application Data

(60) Provisional application No. 61/787,080, filed on Mar. 15, 2013.

(51) Int. Cl.

| | |
|---|---|
| ***F03C 2/00*** | (2006.01) |
| ***F03C 4/00*** | (2006.01) |
| ***F04C 18/00*** | (2006.01) |
| ***F04C 2/12*** | (2006.01) |
| ***F04C 2/08*** | (2006.01) |

(52) U.S. Cl.

CPC ..... *F04C 2/123* (2013.01); *F04C 2/084* (2013.01); *F04C 2/126* (2013.01); *F04C 2230/60* (2013.01); *F04C 2230/85* (2013.01); *Y10T 29/49249* (2015.01)

(58) Field of Classification Search

CPC ..... F04C 2/084; F04C 2/123; F04C 2/126; F04C 2230/00; F04C 2230/60; F04C 2230/70; F04C 2230/80; F04C 2230/85

USPC ..... 418/206.1–206.6, 1, 201.1, 201.3; 29/888.024

See application file for complete search history.

(56) References Cited

U.S. PATENT DOCUMENTS

| | | | | |
|---|---|---|---|---|
| 3,558,246 | A | 1/1971 | Philipp | |
| 4,044,731 | A | 8/1977 | Lindner | |
| 6,827,565 | B1 | 12/2004 | Vogelsang | |
| 8,087,914 | B1 * | 1/2012 | Soderstrom | 418/206.5 |
| 9,017,052 | B1 * | 4/2015 | Soderstrom | 418/206.5 |

FOREIGN PATENT DOCUMENTS

| | | | | |
|---|---|---|---|---|
| JP | 60-237189 A | * | 11/1985 | 418/206.5 |
| JP | 6-229385 A | * | 8/1994 | 418/206.5 |
| WO | WO 2013/019948 A1 | | 2/2013 | |

OTHER PUBLICATIONS

International Search Report and Written Opinion issued Jul. 10, 2014, in corresponding to PCT International Application No. PCT/US2014/024661.

* cited by examiner

*Primary Examiner* — Theresa Trieu

(74) *Attorney, Agent, or Firm* — Finnegan, Henderson, Farabow, Garrett & Dunner, L.L.P.

(57) ABSTRACT

A piston for a pump a hub portion defining opposing outer portions, and inserts configured to provide an adjustable surface coupled to each of the opposing outer portions. The hub portion includes a first hub portion and a second hub portion configured to abut one another. Each of the inserts includes an outer shell and a base portion. The first hub portion includes a plurality of the opposing outer portions, and each of the base portions of the inserts is adjustably coupled to respective opposing outer portions of the first hub portion. A pump includes a housing having an inlet and an outlet, and at least two pistons having a hub portion and inserts. The pump may be a positive-displacement, rotary pump, and the pistons may be circumferential pistons.

48 Claims, 7 Drawing Sheets

PISTON WITH REPLACEABLE AND/OR ADJUSTABLE SURFACES

RELATED APPLICATION

This application claims the benefit of priority under 35 U.S.C. §119(e) of U.S. Provisional Application No. 61/787,080, filed Mar. 15, 2013, the disclosure of which is incorporated herein by reference.

FIELD OF THE DISCLOSURE

The present disclosure relates to a piston with replaceable surfaces, and in particular, a piston with replaceable and/or adjustable outer surfaces.

BACKGROUND

Pumps come in many forms, including, for example, rotodynamic pumps, sometimes referred to as "centrifugal pumps," and positive-displacement pumps. Some positive-displacement pumps include one or more pistons configured to displace materials including fluid such as air, liquid, and/or materials including a combination of fluid, semi-solid materials, and solid materials, such as, for example, sludge. In such pumps, in order to improve operation it may be desirable provide a relatively close fit between the one or more pistons and the housing in which the one or more pistons move. However, providing a relatively close fit may result in drawbacks relating to wear and galling of the one or more pistons and/or the housing.

For example, a positive-displacement, rotary pump having circumferential pistons may be used to pump liquid having therein semi-solid and solid material. In such pumps, providing a relatively close fit between the outer surfaces of the pistons and the pump housing may provide several potential advantages. For example, a relatively close fit may prevent semi-solids and solids from accumulating between the outer surface of the pistons and the pump housing, thereby preventing pump damage. In addition, a relatively close fit may facilitate higher pump pressure by providing a close fit along a sealing line between the piston outer surface and the housing. In addition, a relatively close fit may result in the pump being self-priming.

However, a relatively close fit between the pistons and the housing may result in, for example, galling of the surfaces of the pistons and/or housing. One potential solution to this possible drawback would be to form the pistons from non-galling materials. However, such materials may be expensive. Further, such materials may wear relatively rapidly in abrasive applications.

Therefore, it may be desirable to provide a piston for pumps that may mitigate or solve one or more of the above-noted potential drawbacks.

SUMMARY

In accordance with one aspect of the disclosure, a piston for a pump includes a hub portion defining opposing outer surfaces and concave lateral portions between the opposing outer surfaces. The piston also includes inserts configured to provide a replaceable surface, the inserts being coupled to each of the opposing outer surfaces. According to another aspect, the hub portion includes two lateral hub halves coupled to one another. According to a further aspect, the inserts include a base portion and an outer shell. According to still a further aspect, the lateral hub halves define a recess, and the base portion of the inserts includes a ridge received in the recesses of the lateral hub halves. According to yet another aspect, the inserts are coupled to the opposing outer surfaces via fasteners. According to a further aspect, the hub portion defines apexes of the opposing outer surfaces, and the inserts are coupled to the hub portion at the apexes. According to still another aspect, the apexes define mounting recesses, and the inserts include projections received in the mounting recesses. According to yet another aspect, the inserts are coupled to the mounting recesses via fasteners. According to a further aspect, the hub portion defines lateral recesses, the inserts include lateral mounting flanges and an outer shell extending between the lateral mounting flanges, and the lateral mounting flanges are received in the lateral recesses of the hub portion. According to still another aspect, the lateral flanges of the inserts are coupled to the hub portion via fasteners. According to a further aspect, the hub portion defines a bore configured to receive a pump shaft, and the hub portion defines holes extending between the bore and the outer surfaces. According to still a further aspect, fasteners extend through the holes and couple the inserts to the hub portion. According to another aspect, the hub portion includes at least one of steel, white iron, and duplex. According to a further aspect, the inserts include at least one of a non-galling material and a material having a low coefficient of friction. According to still a further aspect, the piston is a circumferential piston.

According to yet another aspect, a piston includes at least one shim between the hub portion and at least one of the inserts. According to a further aspect, the at least one shim has a substantially constant cross-section. According to another aspect, the at least one shim has a non-uniform cross-section. According to still another aspect, the at least one shim has a profile that substantially matches a profile of the hub portion.

According to yet another aspect, a method for adjusting a distance between the center of the hub portion and the outer surface of the inserts includes providing or removing at least one shim from between the hub portion and the inserts. According to another aspect, a method for adjusting the suction of a pump includes providing or removing at least one shim from between the hub portion and the inserts.

According to still a further aspect, a piston for a pump may include a hub portion defining opposing outer portions, and inserts configured to provide an adjustable surface coupled to each of the opposing outer portions. The hub portion may include a first hub portion and a second hub portion configured to abut one another. Each of the inserts may include an outer shell and a base portion. The first hub portion may include a plurality of the opposing outer portions, and each of the base portions of the inserts may be adjustably coupled to respective opposing outer portions of the first hub portion.

According to a further aspect, a pump may include a housing having an inlet and an outlet, and at least two pistons according to any one of the above-noted aspects. According to still a further aspect, the pump may be a positive-displacement, rotary pump, and the pistons may be circumferential pistons.

According to yet another aspect, a method for adjusting a distance between a center of the hub portion and an outer surface of the inserts may include coupling one of the inserts to the first hub portion via at least one fastener. The method may further include positioning the insert a desired distance from the center of the hub portion, and tightening the at least one fastener to hold the insert at the desired distance.

According to still a further aspect, a method for adjusting the suction of a pump may include adjusting a distance between a center of the hub portion and an outer surface of the inserts of the pistons. The adjusting the distance may include coupling one of the inserts to the first hub portion via at least one fastener, positioning the insert a desired distance from the center of the hub portion, and tightening the at least one fastener to hold the insert at the desired distance.

According to still another aspect, a method of replacing an insert of a pump may include removing a second hub portion from a shaft of the pump to provide access to a first hub portion. The method may also include separating the insert from the first hub portion, coupling a second insert to the first hub portion, and sliding the second hub portion onto the shaft until the second hub portion abuts against the first hub portion.

It is to be understood that both the foregoing general description and the following detailed description are exemplary and explanatory only and are not restrictive of the invention, as claimed.

The accompanying drawings, which are incorporated in and constitute a part of this specification, illustrate several exemplary embodiments of the disclosure and together with the description, serve to explain some principles.

DESCRIPTION OF EXEMPLARY EMBODIMENTS

Reference will now be made in detail to the exemplary embodiments of the disclosure, examples of which are illustrated in the accompanying drawings. Wherever possible, the same reference numbers will be used throughout the drawings to refer to the same or like parts.

Figure 1:
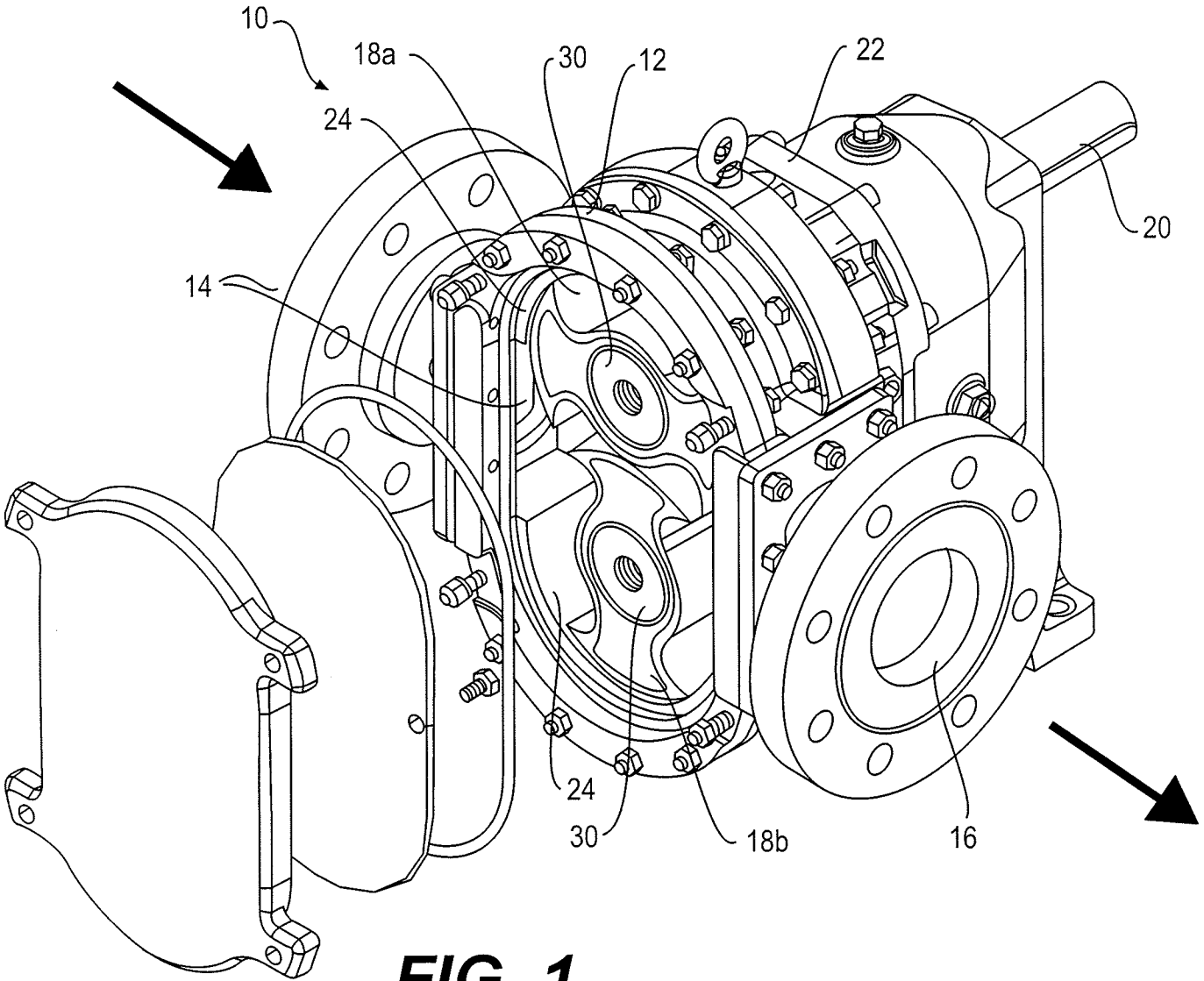
FIG. 1 is a perspective assembly view of an exemplary embodiment of a positive-displacement, rotary pump.

FIG. 1 shows an exemplary embodiment of a pump 10 for pumping material, including liquid, semi-solids, solids, and/or a combination thereof. Exemplary pump 10 is a positive-displacement, rotary pump and includes a housing 12 having an inlet 14 for receiving a material being pumped and an outlet 16 for expelling the pumped material. The exemplary housing 12 contains two circumferential pistons 18*a* and 18*b* configured to rotate within housing 12 along respective axes substantially perpendicular to a path of the material being pumped. Although the exemplary pistons 18*a* and 18*b* shown in FIGS. 1-7B include two opposing lobes, it is contemplated that pistons 18*a* and 18*b* may include more than two opposing lobes, such as, for example, three, four, or five opposing lobes. Pump 10 also includes an input shaft 20 configured to be coupled to a prime mover (not shown), such as, for example, an engine or motor. Input shaft 20 drives a gearbox assembly 22 coupled to pistons 18*a* and 18*b*, such that pistons 18*a* and 18*b* are driven at the same rotational speed in opposite directions.

In the exemplary embodiment shown, as pistons 18*a* and 18*b* rotate within housing 12, suction is created between the respective outer surfaces of pistons 18*a* and 18*b* and inner surfaces 24 of housing 12, thereby pulling material into inlet 14. The outer surfaces of pistons 18*a* and 18*b* and inner surfaces 24 of housing 12 have substantially complimentary radii, resulting in an ability to create greater suction for pulling material into housing inlet 14 due to a greater overlapping area between the outer surfaces of pistons 18*a* and 18*b* and inner surfaces 24 of housing 12. For example, pump 10 may be able to develop 100 pounds per square inch or more pressure. Pistons 18*a* and 18*b* operate as scoops to convey material entering via inlet 14 to outlet 16, thereby potentially being able to pump materials having solids of 0.75 inch or more in the material. According to some embodiments, inner surfaces 24 of housing 12 may be configured to be replaced without replacing other portions of housing 12. This may permit the use of relatively high wear materials (e.g., materials having anti-galling characteristics) for the inner surface 24.

Figure 2B:
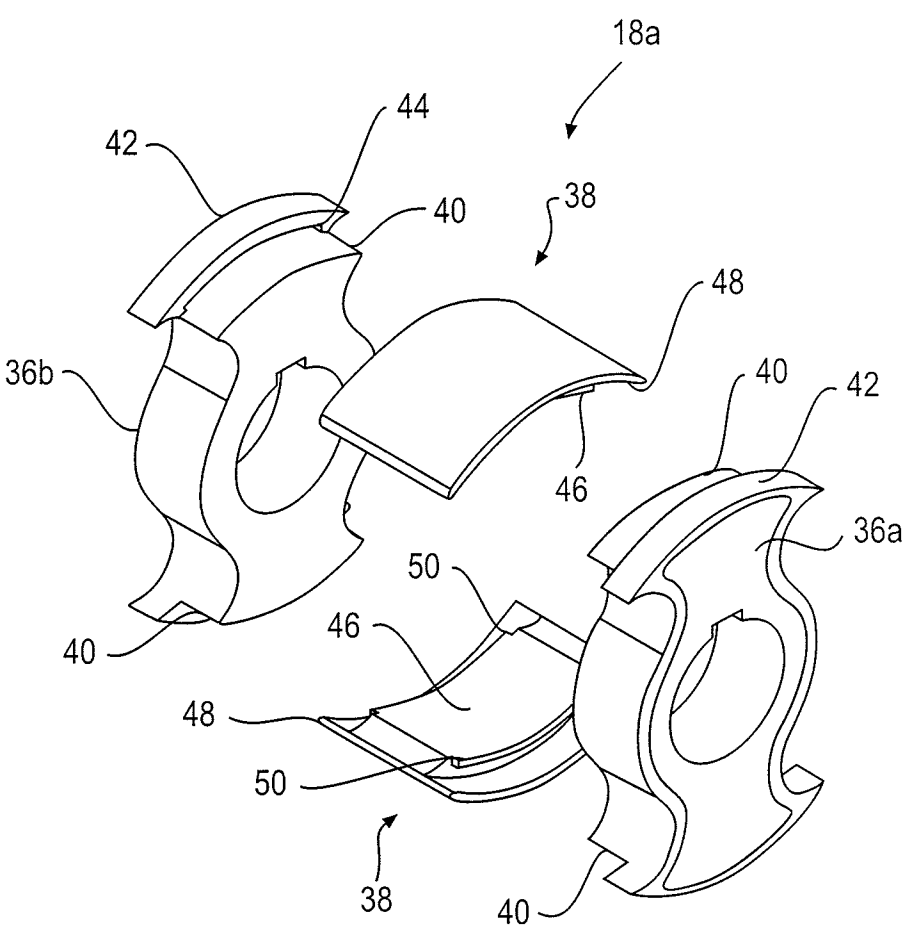
FIG. 2B is a perspective assembly view of the exemplary piston shown in FIG. 2A.
Figure 2A:
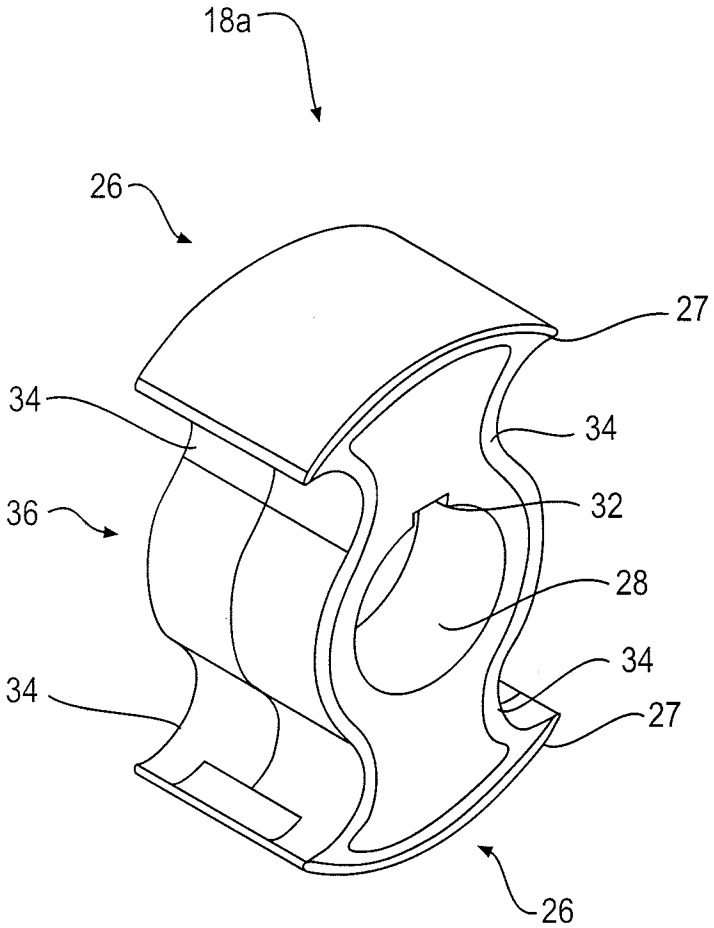
FIG. 2A is a perspective view of an exemplary embodiment of a circumferential piston for a rotary pump.

Referring to FIGS. 2A and 2B, exemplary piston 18*a* includes replaceable surfaces 26. For example, in the exemplary embodiment shown in FIGS. 2A and 2B, piston 18*a* defines an outer diameter presenting two opposing outer surfaces 27 (e.g., opposing arc-shaped surfaces as shown in FIG. 2A or substantially planar surfaces). Between surfaces 27, a bore 28 is provided for mounting piston 18*a* on a shaft 30 driven by gearbox assembly 22 (FIG. 1). A keyway 32 associated with bore 28 is provided for preventing rotation of piston 18*a* relative to shaft 30. A pair of lateral concave scoop sections 34 are provided on each opposing side of piston 18*a*.

According to the exemplary embodiment shown in FIGS. 2A and 2B, surfaces 26 may be replaced. As shown in FIG. 2B, piston 18*a* includes a hub portion 36 including two opposing lateral hub halves 36*a* and 36*b* and two opposing surface inserts 38. Each piston half 36*a* and 36*b* includes a recess 40 and a raised portion 42 at the outer diameter of piston half 36*a* and 36*b*. In the exemplary embodiment shown, a groove 44 is provided in raised portion 42.

Exemplary inserts 38 include a centrally-located base portion 46 and an outer shell 48. Base portion 46 includes ridges 50 configured to be received in grooves 44 of piston halves 36*a* and 36*b*. The outer shell 48 extends over raised portions 42 of piston halves 36*a* and 36*b*. Piston halves 36*a* and 36*b* are coupled to one another, thereby sandwiching inserts 38 between piston halves 36*a* and 36*b*. Piston halves 36*a* and 36*b* may be coupled to one another with, for example, one or more fasteners (not shown), such as screws or bolts. By separating piston halves 36*a* and 36*b* from one another, inserts 38 may be removed and either reconditioned or replaced. According to some embodiments, shims may be used to increase the outer diameter defined by outer shells 48, for example, to provide a closer fit between inserts 38 and inner surfaces 24 of housing 12. This may permit continued use of inserts 38 as they wear thinner from use. Such shims may be placed between base 46 of inserts 38 and recess 40 of piston halves 36*a* and 36*b*.

Because surfaces 26 may be replaced by replacing inserts 38, pistons 18*a* and 18*b* may be dimensioned to provide a relatively close fit with inner surfaces 24 of housing 12. This may prevent semi-solids and solids from accumulating between surface 26 and inner surfaces 24 of housing 12, thereby reducing the likelihood of possible pump damage. In addition, a relatively close fit between surfaces 26 and inner surfaces 24 may facilitate higher pump pressure, and may result pump being self-priming.

Normally, a close fit might result in damage to the pistons and inner surfaces of the housing pump due to, for example, galling. Thus, in order to provide a close fit the pistons would need to be made of special materials that might be undesirably expensive. By virtue of surfaces 26 being replaceable, hub portion 36 may be made of relatively less expensive material (e.g., steel, gray iron, ductile iron, stainless steel, plastics (e.g., when the substance being pumped is corrosive to metals), and/or other less expensive materials), with only inserts 38 being formed of materials such as anti-galling materials and/or materials having a relatively low coefficient of friction. Examples of non-galling materials include, but are not limited to, alloys having a relatively high nickel content and one or more of carbon, manganese, silicon, cobalt, phosphorous, sulfur, copper, molybdenum, iron, chromium, columbium/niobium, Wolfram, vanadium, bismuth, and stannum, which may result in alloys having a high threshold against galling stress. Such alloys include, but are not limited to, ASTM A494/A494M-09'1 CZ100, ASTM A494/A494M-09'1 CW2M, ASTM A494/A494M-09'1 CW6MC, ASTM A494/A494M-09'1 CY5SnBiM, ASTM A494/A494M-09'1 CW12MW, ASTM A494/A494M-09'1 CU5MCuC, ASTM A494/A494M-09'1 CW6MC, and ASTM A494/A494M-09'1 CY40. Other examples of non-galling materials include, but are not limited to soft, non-galling stainless steel, "Waukesha 88" (a nickel-based alloy including one or more of tin, iron, bismuth, and chromium), 808 stainless steel (sometimes known as "Illium 8" or ASTM A494/A494M-09 Cy5SnBiM). Other non-galling materials include nickel-based alloys such as monel, hastalloy, and inconel, which may have a relatively high threshold of galling stress. Use of such materials for inserts 38 may result in an ability to pump low-viscosity fluids.

Examples of materials having a relatively low coefficient of friction include, but are not limited to, TEFLON® (polytetrafluoroethylene) and materials coated and/or impregnated with TEFLON®, such as, for example, aluminum, titanium, steel stainless steel, monel, inconel, brass, and bronze. TEFLON® and materials coated or impregnated with TEFLON® may result in improved volumetric pump efficiency, which may also allow build-up of higher pump pressures. According to some embodiments, inserts 38 may be formed from plastics, such as, for example, thermoplastic fluoropolymers such as polyvinylidene difluoride (PVDF) and homopolymer acetals, such as DELRIN®, and/or combinations thereof. Formation of inserts 38 using other plastics and materials is contemplated.

Figure 3B:
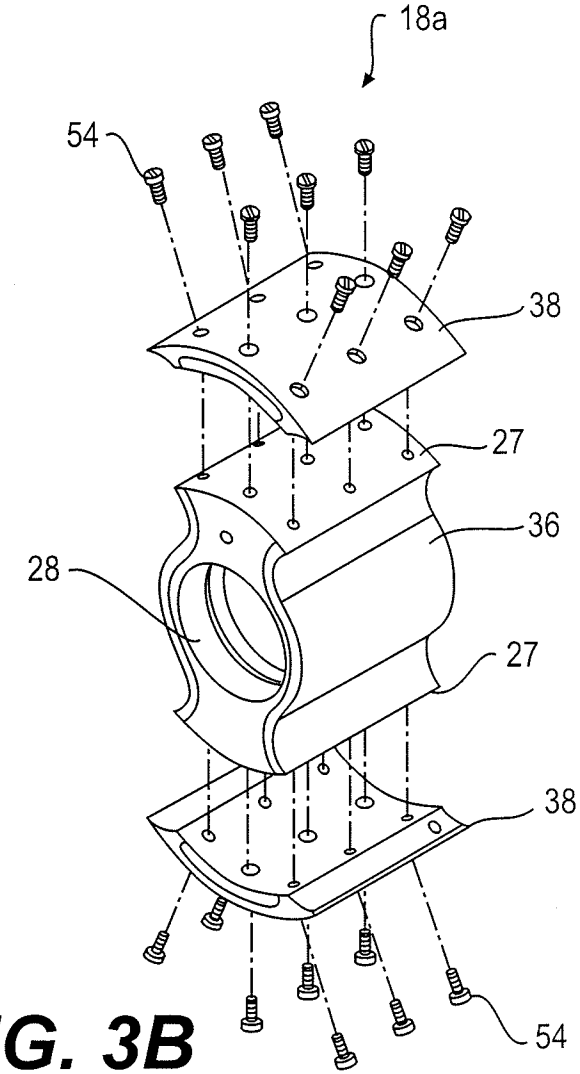
FIG. 3B is a perspective assembly view of the exemplary piston shown in FIG. 3A.
Figure 3A:
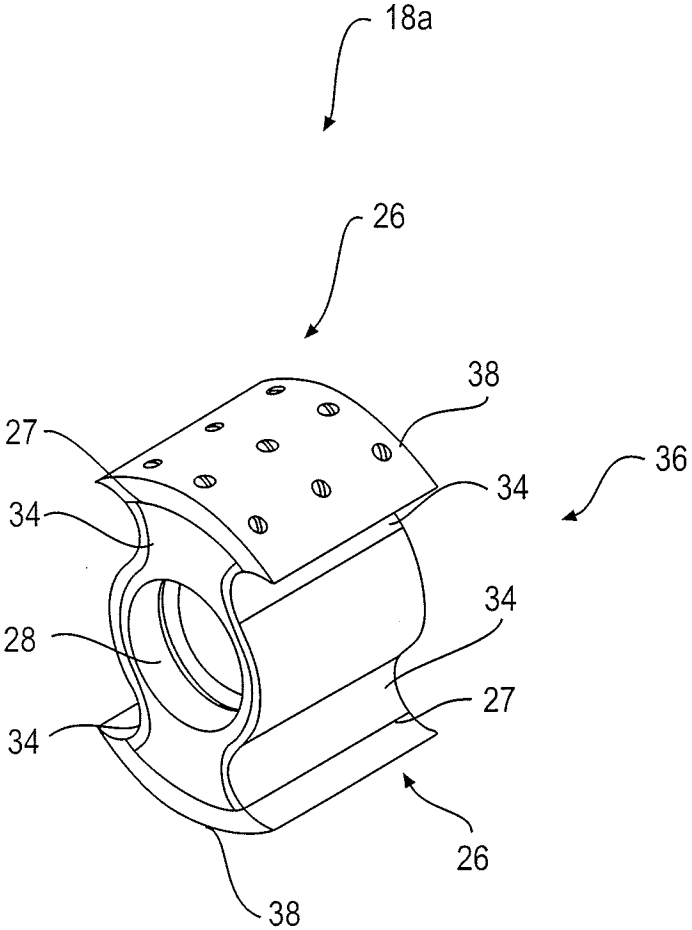
FIG. 3A is a perspective view of another exemplary embodiment of a circumferential piston for a rotary pump.

Similar to the exemplary embodiment shown in FIGS. 2A and 2B, in the exemplary embodiment shown in FIGS. 3A and 3B, surfaces 26 may be replaced. As shown in FIG. 3B, piston 18*a* includes a unitary hub portion 36 defining an outer diameter presenting two opposing surfaces 27, such as the opposing arc-shaped surfaces shown in FIGS. 3A and 3B. Between surfaces 27, hub portion 36 includes a bore 28 for mounting piston 18*a* on shaft 30 driven by gearbox assembly 22. A keyway 32 associated with bore 28 is provided for preventing rotation of piston 18*a* relative to shaft 30. A pair of concave scoop sections 34 are provided on each opposing side of piston 18*a*.

In the exemplary embodiment shown in FIGS. 3A and 3B, two opposing replaceable inserts 38 are located at the outer diameter of hub portion 36. Inserts 38 may be coupled to hub portion 36 by one or more fasteners 54, such as, for example, screws or bolts. Although not shown, the outer diameter of hub portion 36 and/or an inner surface inserts 38 may include structures such as one or more ridges and/or grooves configured to align or maintain alignment of inserts 38 on hub portion 36.

Figure 4B:
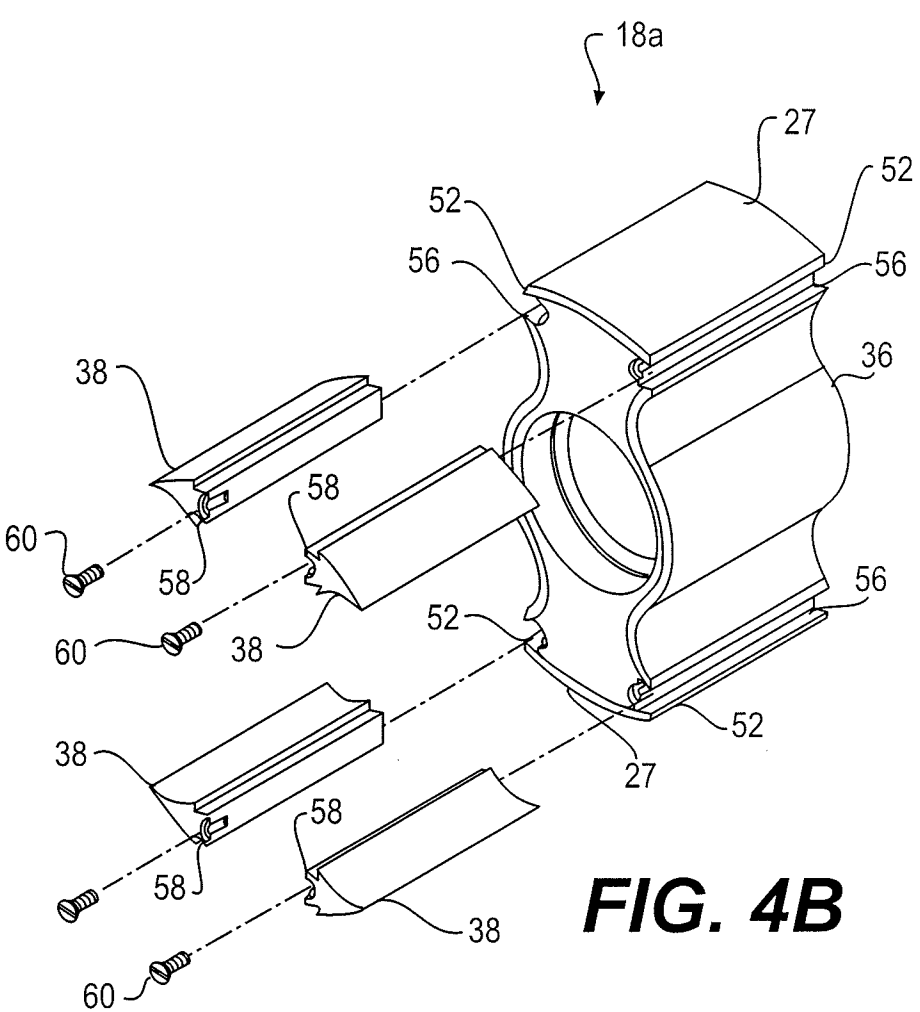
FIG. 4B is a perspective assembly view of the exemplary piston shown in FIG. 4A.
Figure 4A:
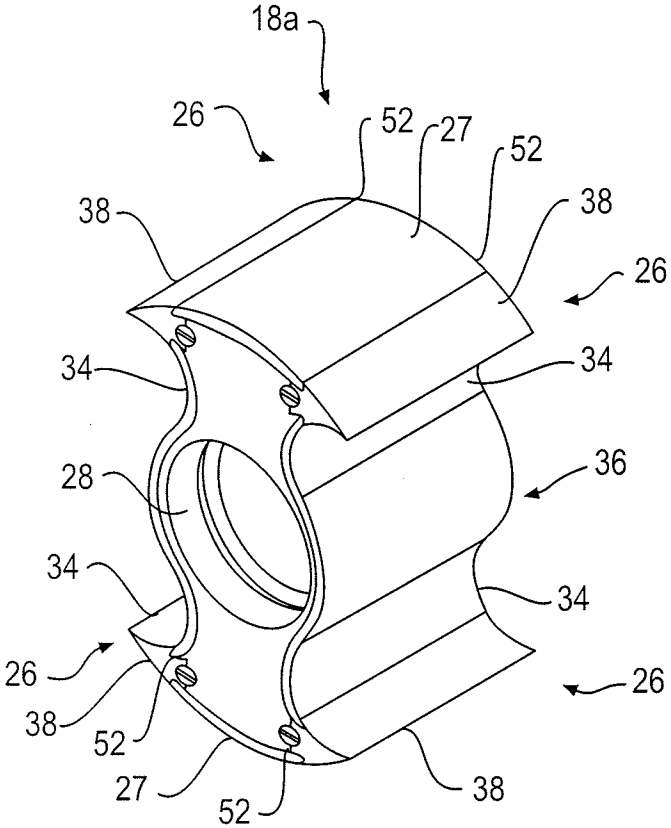
FIG. 4A is a perspective view of another exemplary embodiment of a circumferential piston for a rotary pump.

In the exemplary embodiment shown in FIGS. 4A and 4B, surfaces 26 may be replaced. In this exemplary embodiment, piston 18*a* includes a unitary hub portion 36 defining an outer diameter presenting two opposing surfaces 27, such as opposing arc-shaped surfaces shown in FIGS. 4A and 4B. Between surfaces 27, hub portion 36 includes a bore 28 for mounting piston 18*a* on shaft 30 driven by gearbox assembly 22. A keyway 32 associated with bore 28 is provided for preventing rotation of piston 18*a* relative to shaft 30. A pair of concave scoop sections 34 are provided on each opposing side of piston 18*a*.

As shown in FIG. 4B, piston 18*a* includes opposing replaceable inserts 38 that may be placed at the apexes 52 of surfaces 27 at the ends of concave portions 34 of hub portion 36. In the exemplary embodiment shown, mounting recesses 56 may be provided at each of apexes 52, and each of exemplary inserts 38 may include a cross-sectional projection 58 configured to be received in mounting recesses 56. Inserts 38 may be secured to hub portion 36 by, for example, one or more fasteners 60, such as, for example, screws or bolts. By virtue of fasteners 60 not being exposed to the outer circumferential surface of pistons 18*a* and 18*b*, it may be relatively easier to remove fasteners 60 when servicing or replacing inserts 38, since fasteners 60 are not exposed to the material being pumped or the inner surfaces 24 of housing 12.

Figure 5B:
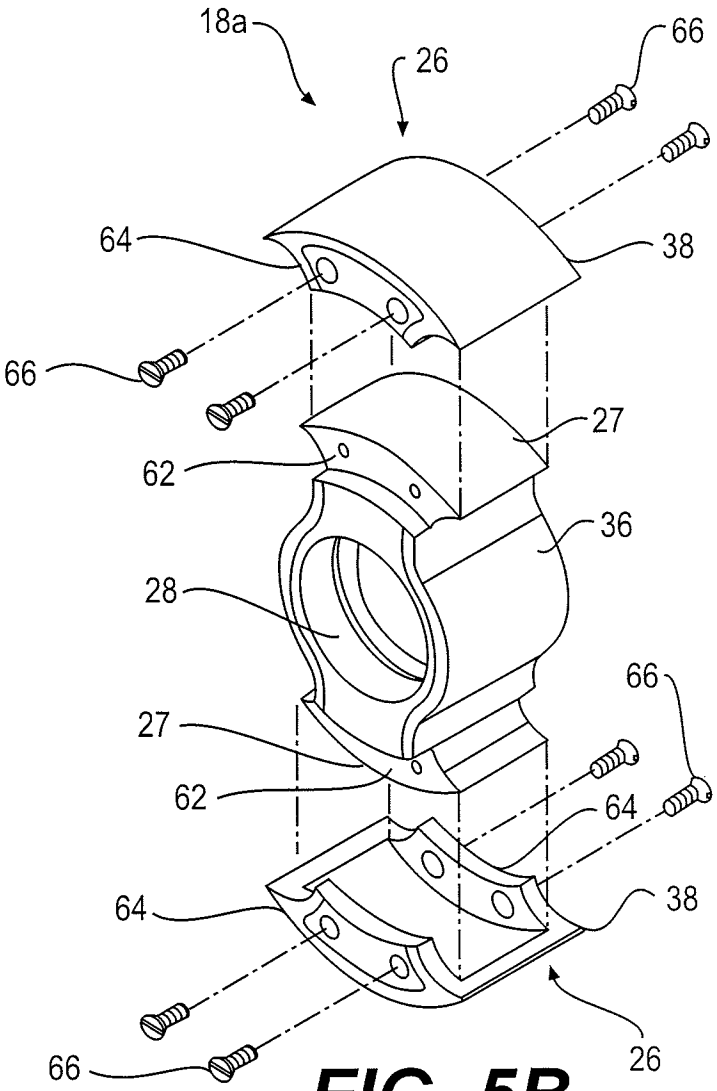
FIG. 5B is a perspective assembly view of the exemplary piston shown in FIG. 5A.
Figure 5A:
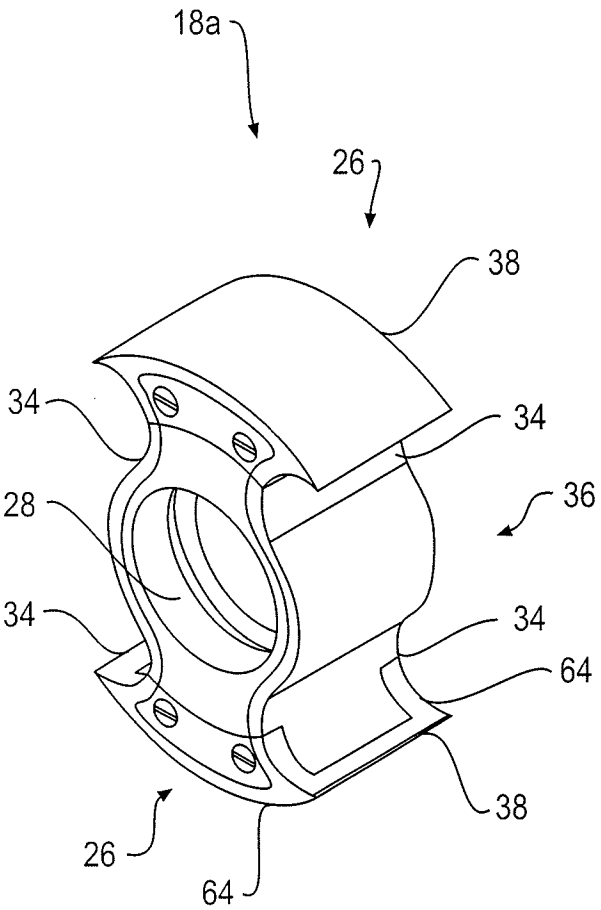
FIG. 5A is a perspective view of another exemplary embodiment of a circumferential piston for a rotary pump.

In the exemplary embodiment shown in FIGS. 5A and 5B, surfaces 26 may be replaced. In this exemplary embodiment, piston 18*a* includes a unitary hub portion 36 defining an outer diameter presenting two opposing outer surfaces 27, such as the opposing arc-shaped surfaces shown in FIGS. 5A and 5B. Between surfaces 27, hub portion 36 includes a bore 28 for mounting piston 18*a* on shaft 30 driven by gearbox assembly 22. A keyway 32 associated with bore 30 is provided for preventing rotation of piston 18*a* relative to shaft 30. A pair of concave scoop sections 34 are provided on each opposing side of piston 18*a*.

In the exemplary embodiment shown in FIGS. 5A and 5B, exemplary hub portion 36 includes lateral recesses 62 adjacent surfaces 27, and exemplary inserts 38 each include a pair lateral mounting flanges 64 and an outer shell 48 extending between lateral mounting flanges 64. Inserts 38 may be secured to hub portion 36 by, for example, one or more fasteners 66 (e.g., screws or bolts), which secure lateral mounting flanges 64 to lateral recesses 62 of hub portion 36. By virtue of fasteners 66 not being exposed to the outer circumferential surface of pistons 18*a* and 18*b*, it may be relatively easier to remove fasteners 66 when servicing or replacing inserts 38, since fasteners 66 are not exposed to the material being pumped or the inner surfaces 24 of housing 12.

Figure 6B:
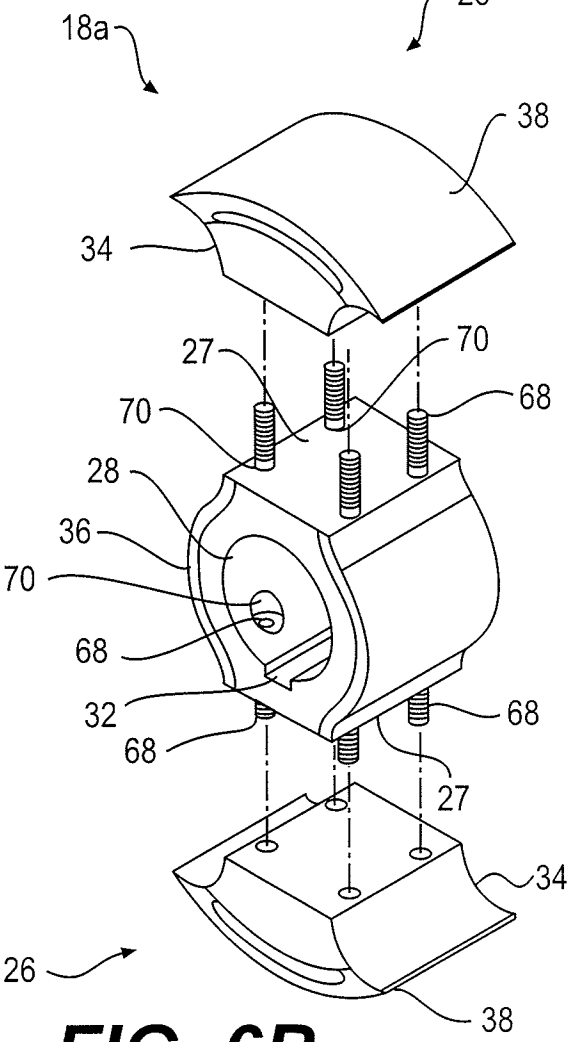
FIG. 6B is a perspective assembly view of the exemplary piston shown in FIG. 5A.
Figure 6A:
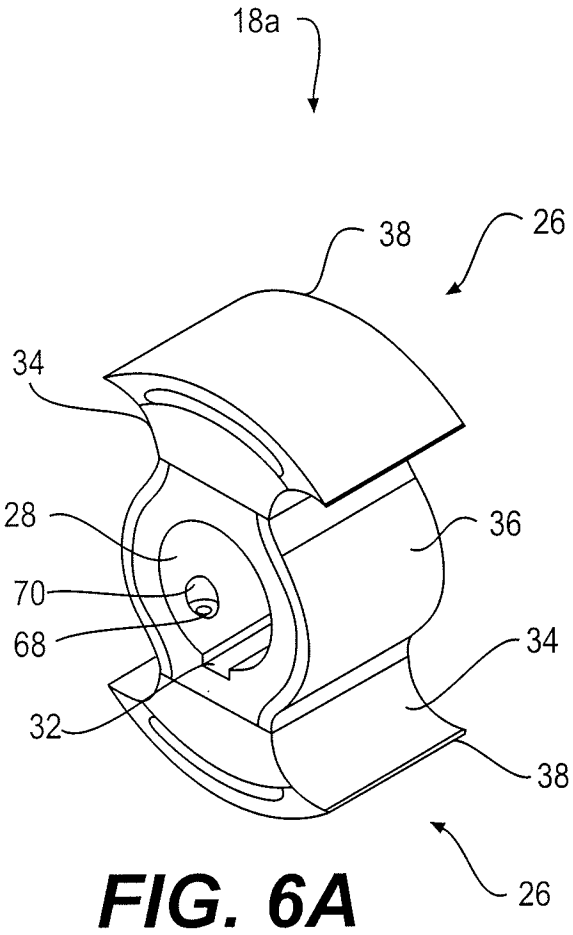
FIG. 6A is a perspective view of another exemplary embodiment of a circumferential piston for a rotary pump.

In the exemplary embodiment shown in FIGS. 6A and 6B, surfaces 26 may be replaced. As shown in FIG. 6B, piston 18*a* includes a unitary hub portion 36 defining opposing outer surfaces 27, such as the substantially planar opposing outer surfaces shown in FIGS. 6A and 6B. Between surfaces 27, hub portion 36 includes a bore 28 for mounting piston 18*a* on shaft 30 driven by gearbox assembly 22. A keyway 32 associated with bore 28 is provided for preventing rotation of piston 18*a* relative to shaft 30. A pair of concave scoop sections 34 are provided on each opposing side of piston 18*a*.

In the exemplary embodiment shown in FIGS. 6A and 6B, two opposing replaceable inserts 38 are located at surfaces 27 of hub portion 36. Inserts 38 may be coupled to hub portion 36 by one or more fasteners 68, such as, for example, screws or bolts. Holes 70 extend from bore 28 of hub portion 36 to surfaces 27, and fasteners 68 extend through holes 70 into inserts 38, thereby coupling inserts 38 to hub portion 36. Thus, fasteners 68 may be accessible for assembly and disassembly of inserts 38 with respect to hub portion 36 via bore 28. By virtue of fasteners 68 not being exposed to the outer circumferential surface of pistons 18*a* and 18*b*, it may be relatively easier to remove fasteners 68 when servicing or replacing inserts 38, since fasteners 68 are not exposed to the material being pumped or the inner surfaces 24 of housing 12.

Inserts 38 shown in FIGS. 6A and 6B may at least partially define scoop sections 34. Although not shown, surfaces 27 of hub portion 36 and/or an inner surface inserts 38 may include structures such as one or more ridges and/or grooves configured to align or maintain alignment of inserts 38 on hub portion 36.

According to some embodiments, it may be possible to adjust the surfaces 26 of any of the exemplary pistons 18*a* described herein, such that the outer surface of the surfaces 26 is farther from the center of piston 18*a*. For example, for some of the exemplary pistons 18*a* described herein, one or more shims may be placed between hub portion 36 and at least one of inserts 38, with inserts 38 thereafter being secured to hub portion 36 according to the exemplary embodiments described herein. As a result, the one or more shims will be sandwiched between a respective hub portion 36 and insert 38, thereby increasing the distance from the center of hub portion 36 and the outer surface of the respective insert 38.

The one or more shims may be relatively thin and may have a substantially constant cross-section. According to some embodiments, the shims may have a non-uniform cross-section. According to some embodiments, the shims may have a slightly curved profile that substantially matches the profile of hub portion 36.

The one or more shims may provide adjustability of the distance between the center of hub portion 36 and an outer surface of inserts 38. This may permit continued use of the same inserts 38 as the inserts 38 wear and become thinner. By providing one or more shims between the hub portion 36 and inserts 38, the useful life of the inserts 38 may be lengthened by maintaining the distance between the center of hub portion 36 and the outer surface of the respective insert 38. In addition, the use of one or more shims may permit adjustment of the suction of pump 10, for example, by increasing or decreasing the distance between the center of hub portion 36 and the outer surface of insert 38. Decreasing the distance may generally result in less suction, and increasing the distance by adding one or more shims between hub portion 36 and a respective insert 38 may result in more suction.

Figure 7B:
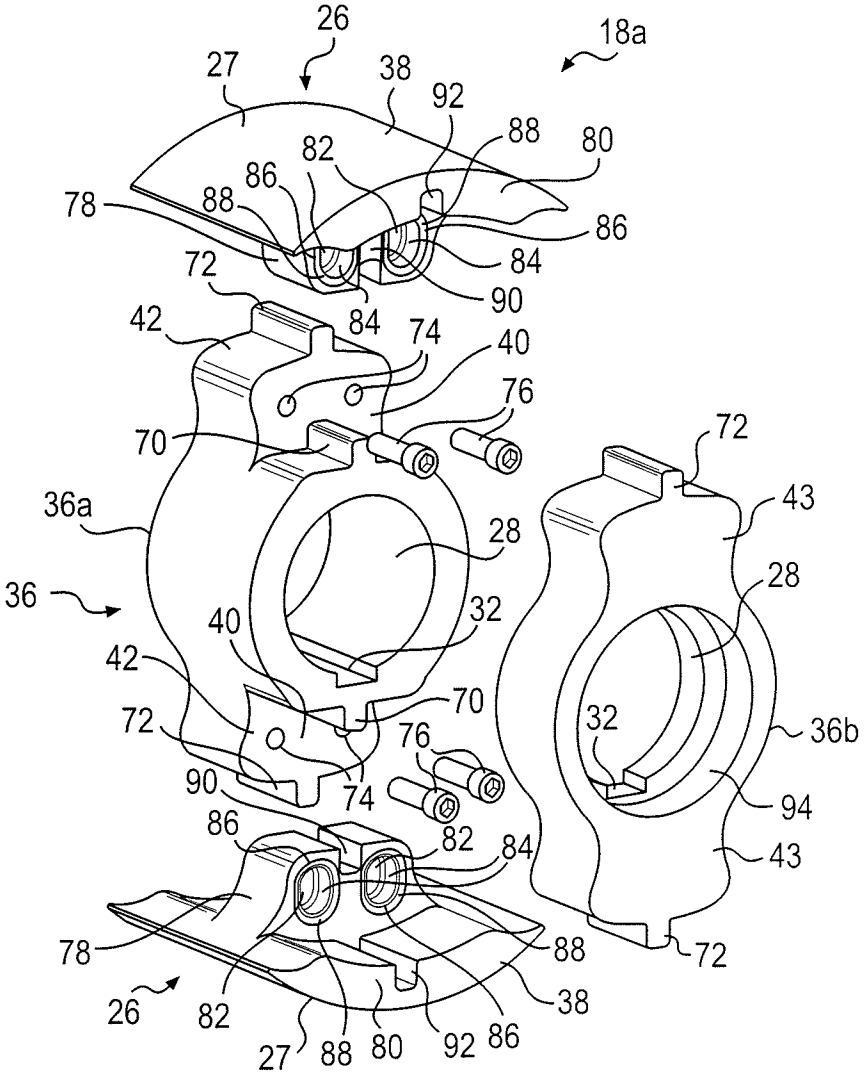
FIG. 7B is a perspective assembly view of the exemplary piston shown in FIG. 7A.
Figure 7A:
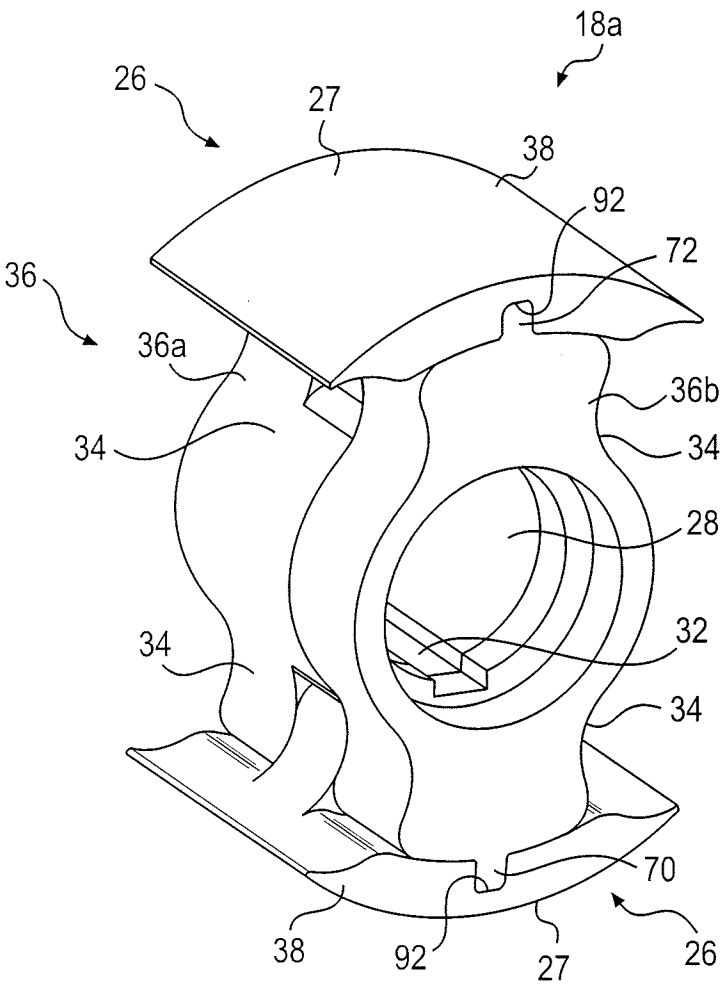
FIG. 7A is a perspective view of another exemplary embodiment of a circumferential piston for a rotary pump.

Referring to FIGS. 7A and 7B, exemplary piston 18*a* includes adjustable surfaces 26. For example, in the exemplary embodiment shown in FIGS. 7A and 7B, piston 18*a* defines an outer diameter presenting two opposing outer surfaces 27 (e.g., opposing arc-shaped surfaces as shown or substantially planar surfaces). Between surfaces 27, a bore 28 is provided for mounting piston 18*a* on shaft 30 driven by gearbox assembly 22 (see FIG. 1). A keyway 32 associated with bore 28 is provided for preventing rotation of piston 18*a* relative to shaft 30. A pair of lateral concave scoop sections 34 are provided on each opposing side of piston 18*a*.

According to the exemplary embodiment shown in FIGS. 7A and 7B, adjustable surfaces 26 may be adjusted radially with respect to the center of bore 28. According to some embodiments, adjustable surfaces 26 may also be replaced as explained in more detail below.

As shown in FIG. 7B, piston 18*a* includes a hub portion 36 including a first hub portion 36*a* (e.g., a front hub portion) and a second hub portion 36*b* (e.g., a rear hub portion) laterally opposing one another, and two opposing adjustable surfaces 26, each in the form of an insert 38. In the exemplary embodiment shown, first hub portion 36*a* defines a pair of radial opposed recesses 40 and a pair of radially opposed raised portions 42 adjacent and partially defining respective recesses 40. Exemplary second hub portion 36*b* includes radially opposed raised portions 43.

In the exemplary embodiment shown in FIGS. 7A and 7B, for the exemplary first hub portion 36*a*, the radial innermost portion of each of recesses 40 includes a seal projection 70, and the radial outermost portion of each of raised portions 42 includes a seal projection 72. Each of radially opposed raised portions 43 of second hub portion 36*b* also includes a seal projection 72. Each of the raised portions 42 of first hub portion 36*a* also includes one of more bores 74 (e.g., threaded bores) extending along an axis parallel to the longitudinal axis of pump shaft 30. One or more bores 74 are configured to receive a corresponding number of fasteners 76 (e.g., fasteners such as bolts). As explained in more detail below, fasteners 76 are used to adjustably couple inserts 38 to the radially opposed raised portions 42 of first hub portion 36*a*.

As shown in FIG. 7B, each of exemplary inserts 38 includes a centrally-located base portion 78 and an outer shell 80 including surfaces 27. Base portions 78 include a number of slots 82 corresponding to the number of bores 74 in raised portions 42 of first hub portion 36*a*. Slots 82 may also include counterbore slots 84 configured to receive the heads of fasteners 76. Base portions 78 may also include recesses 86 configured to receive respective seal members 88 (e.g., o-rings). In the exemplary embodiment shown, inserts 38 are coupled to first hub portion 36*a* via fasteners 76, with seal members 88 received in recesses 86 to provide a fluid seal between first hub portion 36*a* and second hub portion 36*b* (i.e., following installation of second hub portion 36*b* on pump shaft 30, such that second hub portion 36*b* abuts against first hub portion 36*a*).

In the exemplary embodiment shown in FIGS. 7A and 7B, base portions 78 of inserts 38 each include a radially inwardly facing seal groove 90 for receiving seal projection 70 of first hub portion 36*a*, to provide a fluid seal between inserts 38 and first hub portion 36*a*. In addition, outer shells 80 of inserts 38 may each include radially inwardly facing seal grooves 92 for receiving respective seal projections 72 of first and second hub portions 36*a* and 36*b*. Seal projections 70 and 72 and seal grooves 90 and 92 provide a fluid seal between the intake and discharge sides of pump 10.

According to the exemplary embodiment shown in FIG. 7B, second hub portion 36*b* includes a portion of bore 28, a portion of keyway 32, and a counterbore 94 configured to cooperate with a retention bolt and washer (and/or other securing members) (not shown) used to secure piston 18*a* on the end of pump shaft 30. As shown in FIG. 7A, second hub portion 36*b* is configured to abut snugly against first hub portion 36*a* when assembled on pump shaft 30.

The exemplary embodiment shown in FIGS. 7A and 7B may provide for ease of adjusting the radial extent of the outer surfaces 27 of piston 18*a*, and/or for ease of replacement of inserts 38, either by removing the entire piston 18*a* or by removing second hub portion 36*b* from pump shaft 30 without necessarily also removing first hub portion 36*a*.

For example, according to an exemplary method, piston 18*a* shown in FIGS. 7A and 7B may be installed on pump shaft 30 by sliding first hub portion 36*a* onto pump shaft 30 until it comes in contact with a mechanical seal (not shown) with recesses 40 facing outward with respect to pump housing 12 (see FIG. 1). Thereafter (or optionally prior), opposing inserts 38 are secured to first hub portion 36*a* via fasteners 76, with fasteners 76 extending through slots 82 of base portion 78 and into bores 74 of first hub portion 36*a*. Seal members 88 are placed in recesses 86 to provide a fluid seal between first hub portion 36*a* and second hub portion 36*b* upon installation of second hub portion 36*b* onto pump shaft 30. This may prevent or mitigate possible corrosion of fasteners 76, which may result from operation of pump 10.

Prior to installing second hub portion 36*b*, the radial position of outer surfaces 27 of inserts 38 may be set using, for example, a feeler gauge to provide the desired clearance between the outer surfaces 27 and inner surface 24 of housing 12 (see FIG. 1). For example, a feeler gauge having a thickness equal to the desired clearance may be placed between a first of outer surfaces 27 and inner surface 24 of housing 12. The outer surface 27 of associated insert 38 is positioned against the feeler gauge, and fasteners 76 are tightened to the retain the insert 38 and outer surface 27 in the desired radial location relative to first hub portion 36*a*. The feeler gauge is removed. The same process may be used to set the radial position of the outer surface 27 of a second insert 38 relative to first hub portion 36*a*. Following adjustment/installation of inserts 38, second hub portion 36*b* is mounted onto pump shaft 30, such that it abuts against first hub portion 36*a*, thereby compressing seal member(s) 88 between opposing faces of first hub portion 36*a* and second hub portion 36*b*. Second hub portion 36*b* is secured tightly against first hub portion 36*a* by tightening a retention bolt and washer (and/or other securing members) used to secure piston 18*a* on the end of pump shaft 30.

Such an exemplary arrangement may also facilitate adjustment (repositioning) of inserts 38 as outer surfaces 27 wear and/or to alter the suction characteristic of pump 10. For example, with use outer surfaces 27 may wear, thereby increasing the clearance between outer surfaces 27 and inner surface 24 of housing 12. This may result in an undesirable alteration (i.e., a reduction) in the suction of pump 10. However, the desired clearance may be regained by adjusting the radial position of inserts 38.

For example, second hub portion 36*b* may be removed from pump shaft 30, revealing first hub portion 36*a* and fasteners 76. Fasteners 76 may be loosened and a feeler gauge may be used to reposition inserts 38 in the exemplary manner described above to obtain (e.g., regain) the desired clearance between outer surfaces 27 of inserts 38 and inner surface 24 of housing 12.

The exemplary embodiment shown in FIGS. 7A and 7B may facilitate replacing inserts 38 without necessarily replacing the entire piston 18*a*. Moreover, because inserts 38 may be replaced, pistons 18*a* and 18*b* may be dimensioned to provide a relatively close fit with inner surfaces 24 of housing 12. This may prevent semi-solids and solids from accumulating between outer surfaces 27 of inserts 38 and inner surface 24 of housing 12, thereby reducing the likelihood of possible pump damage. In addition, a relatively close fit between outer surfaces 27 and inner surface 24 may facilitate higher pump pressure, and may result in pump 10 being self-priming.

According to some embodiments, adjustable/replaceable surfaces 26 may facilitate dimensioning pistons 18*a* and 18*b* and inner surface 24 of housing 12 to have a close fit. A potential problem with having a close fit is galling of the outer surfaces of pistons 18*a* and 18*b* and/or inner surface 24 of housing 12. One potential solution to this problem would be to use a non-galling material for the pistons. However, such materials are generally very expensive, soft, and consequently wear rapidly in abrasive applications. By providing pistons 18*a* and 18*b* with adjustable/replaceable surfaces 26, non-galling materials can be limited to the adjustable/replaceable surfaces 26, while the remaining portion of pistons 18*a* and 18*b* (e.g., hub portions 36) can be made of more suitable materials, such as steel, white iron, duplex, and/or other less expensive materials.

Other embodiments of the disclosure will be apparent to those skilled in the art from consideration of the specification and practice of the embodiments disclosed herein. It is intended that the specification and examples be considered as exemplary only, with a true scope and spirit of the disclosure being indicated by the following claims.

What is claimed is:

1. A piston for a pump, the piston comprising:
- a hub portion defining opposing outer portions; and
- inserts configured to provide an adjustable surface coupled to each of the opposing outer portions,
- wherein the hub portion comprises a first hub portion and a second hub portion configured to abut one another,
- wherein each of the inserts comprises an outer shell and a base portion,
- wherein the first hub portion comprises a plurality of the opposing outer portions,
- wherein each of the base portions of the inserts is adjustably coupled to respective opposing outer portions of the first hub portion,
- wherein each the opposing outer portions of the first hub portion comprises a raised portion and a recess, and
- wherein the raised portion comprises at least one bore configured to receive a fastener configured to couple one of the inserts to the first hub portion.

2. The piston of claim 1, wherein each of the base portions defines at least one slot configured to receive a fastener.

3. The piston of claim 1, further comprising at least one seal member configured to prevent corrosion of the fastener.

4. The piston of claim 1, wherein each of the raised portions comprises a seal projection, and each of the outer shells of the inserts comprises at least one seal groove configured to receive the seal projection.

5. The piston of claim 1, wherein each of the opposing outer portions of the second hub portion comprises a raised portion comprising a seal projection, and each of the outer shells of the inserts comprises at least one seal groove configured to receive the seal projection of the second hub portion.

6. The piston of claim 1, wherein each of the recesses of the first hub portion comprises a seal projection, and each of the base portions of the inserts comprises at least one seal groove configured to receive the seal projection.

7. The piston of claim 1, wherein each of the base portions of the inserts is adjustably coupled to respective opposing outer portions of the first hub portion, such that a radial distance between a center of the hub portion and the outer shell is adjustable.

8. The piston of claim 1, wherein the hub portion comprises at least one of steel, white iron, and duplex.

9. The piston of claim 1, wherein the inserts comprise at least one of a non-galling material and a material having a low coefficient of friction.

10. The piston of claim 1, wherein the piston is a circumferential piston.

11. A pump comprising:

a housing having an inlet and an outlet; and at least two pistons according to claim 1.

12. The pump of claim 11, wherein the pump is a positive-displacement, rotary pump, and the pistons are circumferential pistons.

13. A method for adjusting a distance between a center of the hub portion and an outer surface of the inserts of a piston, the piston comprising:

a hub portion defining opposing outer portions; and inserts configured to provide an adjustable surface coupled to each of the opposing outer portions, wherein the hub portion comprises a first hub portion and a second hub portion configured to abut one another, wherein each of the inserts comprises an outer shell and a base portion, wherein the first hub portion comprises a plurality of the opposing outer portions, wherein each of the base portions of the inserts is adjustably coupled to respective opposing outer portions of the first hub portion, wherein each of the opposing outer portions of the first hub portion comprises a raised portion and a recess, and wherein the raised portion comprises at least one bore configured to receive a fastener configured to couple one of the inserts to the first hub portion, and the method comprising:

coupling one of the inserts to the first hub portion via at least one fastener;

positioning the insert a desired distance from the center of the hub portion; and tightening the at least one fastener to hold the insert at the desired distance.

14. A method for adjusting the suction of a pump, the pump comprising:

a housing having an inlet and an outlet; and at least two pistons, each of the at least two pistons comprising:

a hub portion defining opposing outer portions; and inserts configured to provide an adjustable surface coupled to each of the opposing outer portions, wherein the hub portion comprises a first hub portion and a second hub portion configured to abut one another, wherein each of the inserts comprises an outer shell and a base portion, wherein the first hub portion comprises a plurality of the opposing outer portions, wherein each of the base portions of the inserts is adjustably coupled to respective opposing outer portions of the first hub portion, wherein each of the opposing outer portions of the first hub portion comprises a raised portion and a recess, and wherein the raised portion comprises at least one bore configured to receive a fastener configured to couple one of the inserts to the first hub portion, and the method comprising:

adjusting a distance between a center of the hub portion and an outer surface of the inserts of the pistons, adjusting the distance comprising:

coupling one of the inserts to the first hub portion via at least one fastener;

positioning the insert a desired distance from the center of the hub portion; and tightening the at least one fastener to hold the insert at the desired distance.

15. The method of claim 14, wherein positioning the insert the desired distance from the center of the hub portion comprises:

inserting a feeler gauge between the outer surface of the insert and the housing of the pump;

positioning the insert such that the feeler gauge is sandwiched between the outer surface of the insert and the housing; and tightening the at least one fastener.

16. A method of replacing an insert of a pump, the pump comprising:

a housing having an inlet and an outlet; and at least two pistons, each of the at least two pistons comprising:

a hub portion defining opposing outer portions; and inserts configured to provide an adjustable surface coupled to each of the opposing outer portions, wherein the hub portion comprises a first hub portion and a second hub portion configured to abut one another, wherein each of the inserts comprises an outer shell and a base portion, wherein the first hub portion comprises a plurality of the opposing outer portions, and wherein each of the base portions of the inserts is adjustably coupled to respective opposing outer portions of the first hub portion, and wherein the method comprises:

removing the second hub portion from a shaft of the pump to provide access to the first hub portion;

separating the insert from the first hub portion;

coupling a second insert to the first hub portion; and sliding the second hub portion onto the shaft until the second hub portion abuts against the first hub portion.

17. The method of claim 16, wherein coupling the second insert to the first hub portion comprises:

coupling the second insert to the first hub portion via at least one fastener;

positioning the second insert a desired distance from the center of the hub portion; and tightening the at least one fastener to hold the second insert at the desired distance.

18. The method of claim 17, wherein positioning the second insert the desired distance from the center of the hub portion comprises:

inserting a feeler gauge between an outer surface of the second insert and the housing of the pump;

positioning the second insert such that the feeler gauge is sandwiched between the outer surface of the second insert and the housing; and tightening the at least one fastener.

19. A piston for a pump, the piston comprising:

a hub portion defining opposing outer portions; and inserts configured to provide an adjustable surface coupled to each of the opposing outer portions, wherein the hub portion comprises a first hub portion and a second hub portion configured to abut one another, wherein each of the inserts comprises an outer shell and a base portion, wherein the first hub portion comprises a plurality of the opposing outer portions, wherein each of the base portions of the inserts is adjustably coupled to respective opposing outer portions of the first hub portion, wherein each of the opposing outer portions of the first hub portion comprises a raised portion and a recess, and wherein each of the raised portions comprises a seal projection, and each of the outer shells of the inserts comprises at least one seal groove configured to receive the seal projection.

20. The piston of claim 19, wherein each of the base portions defines at least one slot configured to receive a fastener.

21. The piston of claim 19, wherein the raised portion comprises at least one bore configured to receive a fastener configured to couple one of the inserts to the first hub portion.

22. The piston of claim 21, further comprising at least one seal member configured to prevent corrosion of the fastener.

23. The piston of claim 19, wherein each of the base portions of the inserts is adjustably coupled to respective opposing outer portions of the first hub portion, such that a radial distance between a center of the hub portion and the outer shell is adjustable.

24. The piston of claim 19, wherein the hub portion comprises at least one of steel, white iron, and duplex.

25. The piston of claim 19, wherein the inserts comprise at least one of a non-galling material and a material having a low coefficient of friction.

26. The piston of claim 19, wherein the piston is a circumferential piston.

27. A pump comprising:

a housing having an inlet and an outlet; and at least two pistons according to claim 19.

28. The pump of claim 27, wherein the pump is a positive-displacement, rotary pump, and the pistons are circumferential pistons.

29. A piston for a pump, the piston comprising:

a hub portion defining opposing outer portions; and inserts configured to provide an adjustable surface coupled to each of the opposing outer portions, wherein the hub portion comprises a first hub portion and a second hub portion configured to abut one another, wherein each of the inserts comprises an outer shell and a base portion, wherein the first hub portion comprises a plurality of the opposing outer portions, wherein each of the base portions of the inserts is adjustably coupled to respective opposing outer portions of the first hub portion, wherein each of the opposing outer portions of the first hub portion comprises a raised portion and a recess, and wherein each of the opposing outer portions of the second hub portion comprises a raised portion comprising a seal projection, and each of the outer shells of the inserts comprises at least one seal groove configured to receive the seal projection of the second hub portion.

30. The piston of claim 29, wherein each of the base portions defines at least one slot configured to receive a fastener.

31. The piston of claim 29, wherein the raised portion comprises at least one bore configured to receive a fastener configured to couple one of the inserts to the first hub portion.

32. The piston of claim 31, further comprising at least one seal member configured to prevent corrosion of the fastener.

33. The piston of claim 29, wherein each of the base portions of the inserts is adjustably coupled to respective opposing outer portions of the first hub portion, such that a radial distance between a center of the hub portion and the outer shell is adjustable.

34. The piston of claim 29, wherein the hub portion comprises at least one of steel, white iron, and duplex.

35. The piston of claim 29, wherein the inserts comprise at least one of a non-galling material and a material having a low coefficient of friction.

36. The piston of claim 29, wherein the piston is a circumferential piston.

37. A pump comprising:

a housing having an inlet and an outlet; and at least two pistons according to claim 29.

38. The pump of claim 37, wherein the pump is a positive-displacement, rotary pump, and the pistons are circumferential pistons.

39. A piston for a pump, the piston comprising:

a hub portion defining opposing outer portions; and inserts configured to provide an adjustable surface coupled to each of the opposing outer portions, wherein the hub portion comprises a first hub portion and a second hub portion configured to abut one another, wherein each of the inserts comprises an outer shell and a base portion, wherein the first hub portion comprises a plurality of the opposing outer portions, wherein each of the base portions of the inserts is adjustably coupled to respective opposing outer portions of the first hub portion, wherein each of the opposing outer portions of the first hub portion comprises a raised portion and a recess, and wherein each of the recesses of the first hub portion comprises a seal projection, and each of the base portions of the inserts comprises at least one seal groove configured to receive the seal projection.

40. The piston of claim 39, wherein each of the base portions defines at least one slot configured to receive a fastener.

41. The piston of claim 39, wherein the raised portion comprises at least one bore configured to receive a fastener configured to couple one of the inserts to the first hub portion.

42. The piston of claim 41, further comprising at least one seal member configured to prevent corrosion of the fastener.

43. The piston of claim 39, wherein each of the base portions of the inserts is adjustably coupled to respective opposing outer portions of the first hub portion, such that a radial distance between a center of the hub portion and the outer shell is adjustable.

44. The piston of claim 39, wherein the hub portion comprises at least one of steel, white iron, and duplex.

45. The piston of claim 39, wherein the inserts comprise at least one of a non-galling material and a material having a low coefficient of friction.

46. The piston of claim 39, wherein the piston is a circumferential piston.

47. A pump comprising:

a housing having an inlet and an outlet; and at least two pistons according to claim 39.

48. The pump of claim 47, wherein the pump is a positive-displacement, rotary pump, and the pistons are circumferential pistons.

* * * * *